US010128613B2

(12) United States Patent
Yang

(10) Patent No.: US 10,128,613 B2
(45) Date of Patent: Nov. 13, 2018

(54) PIN CONNECTOR ASSEMBLY

(71) Applicant: Puleo International Inc., South Plainfield, NJ (US)

(72) Inventor: Ping Yang, Dongguan (CN)

(73) Assignee: Puleo International Inc., South Plainfield, NJ (US)

( * ) Notice: Subject to any disclaimer, the term of this patent is extended or adjusted under 35 U.S.C. 154(b) by 0 days.

(21) Appl. No.: 15/837,292

(22) Filed: Dec. 11, 2017

(65) Prior Publication Data

US 2018/0102609 A1 Apr. 12, 2018

Related U.S. Application Data

(63) Continuation-in-part of application No. 15/337,738, filed on Oct. 28, 2016.

(30) Foreign Application Priority Data

Oct. 29, 2015 (CN) ..... 2015 2 0862024 U

(51) Int. Cl.

| | |
|---|---|
| ***H01R 13/631*** | (2006.01) |
| ***H01R 24/20*** | (2011.01) |
| ***H01R 13/641*** | (2006.01) |
| ***H01R 24/28*** | (2011.01) |
| *H01R 107/00* | (2006.01) |

(52) U.S. Cl.

CPC ..... *H01R 13/631* (2013.01); *H01R 13/641* (2013.01); *H01R 24/20* (2013.01); *H01R 24/28* (2013.01); *H01R 2107/00* (2013.01)

(58) Field of Classification Search

CPC ... H01R 13/631; H01R 13/6456; H01R 24/20
See application file for complete search history.

(56) References Cited

U.S. PATENT DOCUMENTS

| | | | | |
|---|---|---|---|---|
| 3,901,574 A * | 8/1975 | Paullus | H01R 13/623 | 285/401 |
| 3,953,099 A * | 4/1976 | Wilson | H01R 13/50 | 439/205 |
| 4,284,312 A * | 8/1981 | Patchett | H01R 13/5219 | 439/281 |
| 4,310,213 A * | 1/1982 | Fetterolf, Sr. | H01R 13/516 | 439/320 |
| 4,493,525 A * | 1/1985 | Hall | H01R 9/032 | 439/607.47 |

(Continued)

*Primary Examiner* — Ross Gushi
(74) *Attorney, Agent, or Firm* — C. G. Mersereau; Nikolai & Mersereau, P.A.

(57) ABSTRACT

A pin connector assembly has male connector and a female connector. The male connector has a first alignment slot formed on a first housing of the male connector and a mounting hole. The female connector has a second alignment slot formed on a second housing of the male connector and a mounting hole. The first and second alignment slots allows the male connector and the female to be coupled with each other without damaging metal contacts on the male connector. Moreover, the installation efficiency of the male connector and the female connectors are improved. The mounting holes of the male and female connectors are used for detachably mounting the male and female connectors on tubes of a trunk of an artificial Christmas tree.

13 Claims, 3 Drawing Sheets

(56) References Cited

U.S. PATENT DOCUMENTS 4,531,798 A * 7/1985 Baur ..... H01R 13/629 439/272
4,650,270 A * 3/1987 Tajima ..... H01R 13/6593 439/607.27
4,685,758 A * 8/1987 Yoshida ..... H01R 9/032 439/606
4,737,124 A * 4/1988 Ezure ..... H01R 23/26 439/585
4,801,277 A * 1/1989 Seilhan ..... H01R 13/64 439/597
4,857,008 A * 8/1989 Kee ..... H01R 13/504 439/352
4,954,097 A * 9/1990 Sekiguchi ..... H01R 13/627 439/352
4,960,388 A * 10/1990 Frantz ..... H01R 9/031 439/404
4,960,389 A * 10/1990 Frantz ..... H01R 9/031 439/404
4,969,839 A * 11/1990 Nilsson ..... H01R 4/2429 439/395
5,007,862 A * 4/1991 Defibaugh ..... H01R 13/64 439/564
5,417,585 A * 5/1995 Morin ..... H01R 13/465 439/488
5,662,488 A * 9/1997 Alden ..... H01R 13/625 439/314
5,791,939 A * 8/1998 Tanigawa ..... H01R 9/0518 439/607.01
6,010,348 A * 1/2000 Alden ..... H01R 13/506 439/274
6,585,393 B1 * 7/2003 Brandes ..... A47F 3/001 362/235
6,855,888 B2 * 2/2005 Jacke ..... H01R 13/59 174/84 R
6,893,144 B2 * 5/2005 Fan ..... H01R 13/5219 362/219
6,942,516 B2 * 9/2005 Shimoyama ..... H01R 13/6272 439/352
7,134,894 B2 * 11/2006 Murphy ..... H01R 9/05 439/307
7,195,505 B1 * 3/2007 Becker ..... H01R 13/5219 439/271
7,306,472 B2 * 12/2007 Matsumoto ..... H01R 13/6273 439/314
7,422,463 B2 * 9/2008 Kuo ..... H01R 13/5205 439/277
7,429,193 B2 * 9/2008 Cairns ..... H01R 13/521 439/271
7,470,154 B2 * 12/2008 Sato ..... H01R 13/03 439/693
7,641,517 B2 * 1/2010 Vogt ..... H01R 33/0836 362/651
7,666,028 B2 * 2/2010 Meleck ..... H01R 13/6272 439/502
7,669,479 B2 * 3/2010 Kurtz ..... G01K 7/023 73/714
7,674,137 B2 * 3/2010 Sato ..... H01R 13/03 439/693
7,892,042 B2 * 2/2011 Spicer ..... H01R 13/645 439/680
7,927,108 B2 * 4/2011 Gong ..... H01R 13/7031 439/63
8,025,536 B1 * 9/2011 Kelly ..... H01R 13/6456 439/681
8,052,480 B2 * 11/2011 Hauser ..... H01R 13/24 439/672
8,192,216 B1 * 6/2012 Puluc ..... H01R 13/64 439/271
8,197,265 B1 6/2012 Lee et al.
8,328,574 B1 * 12/2012 Lin ..... H01R 13/6275 439/321
8,540,527 B2 * 9/2013 Puluc ..... H01R 13/64 439/271
8,979,559 B2 * 3/2015 Aldrich ..... H01R 13/516 439/133
9,337,582 B2 * 5/2016 Sato ..... H01R 13/6456
9,362,657 B1 * 6/2016 Yang ..... A47G 33/12
9,368,907 B2 * 6/2016 Becker ..... H01R 13/5221
9,450,334 B2 * 9/2016 Haas ..... H01R 13/64
9,478,912 B1 * 10/2016 Zusman ..... H01R 13/645
2005/0186825 A1 * 8/2005 Yen ..... H01R 33/7614 439/336
2006/0046579 A1 * 3/2006 Karadimas ..... H01R 13/6456 439/680
2006/0051999 A1 * 3/2006 Allemann ..... H01R 13/622 439/320
2015/0200490 A1 * 7/2015 Elia ..... F21S 8/08 362/414
2017/0125945 A1 * 5/2017 Ping ..... H01R 13/631
2018/0102609 A1 * 4/2018 Yang ..... H01R 13/631
2018/0131129 A1 * 5/2018 Plested ..... H01R 13/625

* cited by examiner

PIN CONNECTOR ASSEMBLY

CROSS-REFERENCE TO RELATED PATENT APPLICATION

The present application is a continuation-in-part application that claims the benefit of a pending U.S. patent application Ser. No. 15/337,738, entitled "PIN CONNECTOR" and filed on Oct. 28, 2016, which claims priority to a Chinese Patent Application No. 201520862024.8, filed on Oct. 29, 2015.

BACKGROUND OF THE INVENTION

1. Field of the Invention

The present invention relates to an electrical connector, especially to a pin connector assembly that is used on an artificial Christmas tree.

2. Description of the Prior Art(s)

With the spread of Christmas culture, artificial Christmas trees with light decorations have become popular decorations to increase Christmas holiday atmosphere. The artificial Christmas tree available on the market typically includes a trunk, multiple branches, multiple wires, and multiple decoration lights that are connected through the wires. To facilitate storage, the trunk can be divided into multiple tubes. The trunk, the branches, the wires, and the decoration lights can be manually assembled together. In order to avoid the problem associated with a very long wire, each of the wires of the artificial Christmas tree can be divided into multiple shorter wires and the shorter wires are connected with each other via electrical connectors.

One of the shorter wires is introduced into the trunk from a bottom of the trunk, protrudes out from a side of the trunk, and then is connected to the other shorter wire via a conventional connector assembly. The conventional connector assembly comprises a male connector and a female connector. The male connector is mounted in one of the tubes of the trunk and engages with an inner sidewall of the tube. The female connector is mounted the other tube of the trunk and engages with the inner sidewall of the tube. Two of the shorter wires are respectively connected electrically to the male connector and the female connector. Thus, when connecting two of the tubes, the male connector in one of the two tubes can electrically connected with the female connector in the other tube. Accordingly, the shorter wires can electrically connected with each other via the male connector and the female connector.

However, since there is no guiding structure or alignment structure between the male connector and the female connector, it is hard to accurately insert each metal contact on the male connector into a corresponding insertion hole on the female connector. As a result, the installation efficiency is pretty low; and it is pretty easy to damage the metal contacts on the male connector. Consequently, the service life of the conventional connector assembly is reduced. Moreover, due to manufacturing errors, wall thicknesses of each of the tubes may vary. Therefore, when the male connector and the female connector are mounted in the tubes, the male connector and the female connector may be unable to securely engage with the inner sidewalls of the tubes, causing the male connector and the female connector to drop from the tubes easily.

To overcome the shortcomings, the present invention provides a pin connector assembly to mitigate or obviate the aforementioned problems.

SUMMARY OF THE INVENTION

The main objective of the present invention is to provide a pin connector assembly that has a male connector and a female connector.

The male connector has a first housing, multiple metal contacts, a mounting hole, a first alignment slot, and at least one engaging protrusion. The first housing is tubular and elongated, and has a mounting end, a connecting end having an end surface, an outer side surface, a receiving recess axially formed in the end surface of the connecting end of the first housing, an inner side surface defined around the receiving recess, and an inner bottom defined in the receiving recess. The metal contacts are mounted in the receiving recess and on the inner bottom of the first housing. The mounting hole of the male connector is radially formed through the mounting end of the first housing. The first alignment slot is formed on the outer side surface of the first housing and axially extends along the first housing. The at least one engaging protrusion is formed on the inner side surface of the first housing.

The female connector has a second housing, a plug portion, a mounting hole, a second alignment slot, and at least one engaging slot. The second housing is tubular and elongated, and has a mounting end, a connecting end, and an outer side surface. The plug portion axially protrudes from the connecting end of the second housing, fits within the receiving recess of the first housing of the male connector, and has multiple insertion holes formed in an end surface of the plug portion and respectively corresponding in position to the metal contacts of the male connector for the metal contacts to be respectively inserted into the insertion holes. The mounting hole of the female connector is radially formed through the mounting end of the second housing. The second alignment slot are formed on the outer side surface of the second housing, axially extends along the second housing, and aligns with the first alignment slot of the male connector when the female connector and the male connector are electrically coupled together. The at least one engaging slot is formed in the outer side surface of the plug portion. Each of the at least one engaging slot extends axially and receives and engages with a corresponding one of the at least one engaging protrusion of the male connector when the female connector and the male connector are electrically coupled together.

With the first alignment slot on the outer side surface of the first housing and the second alignment slot of the outer side surface of the second housing, the plug portion of the female connector is able to be inserted into the receiving recess of the male connector by aligning the first alignment slot with the second alignment slot, so as to properly insert the metal contacts of the male connector into the insertion holes of the female connector. The metal contacts are not damaged and the service life of the pin connector assembly is prolonged. Moreover, the installation efficiency of the male connector and the female connectors is efficiently improved, such that assembling the tubes of the trunk of the artificial Christmas tree can be facilitated.

By detachably mounting the male connector and the female connector on the tube of the trunk of the artificial Christmas tree via the mounting holes, shapes of the first housing and the second housing do not have to accurately fit shapes of the tube, such that manufacture of the artificial Christmas tree can also be facilitated. Moreover, the male connector and the female connector are able to be easily detached from the tube for replacement.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
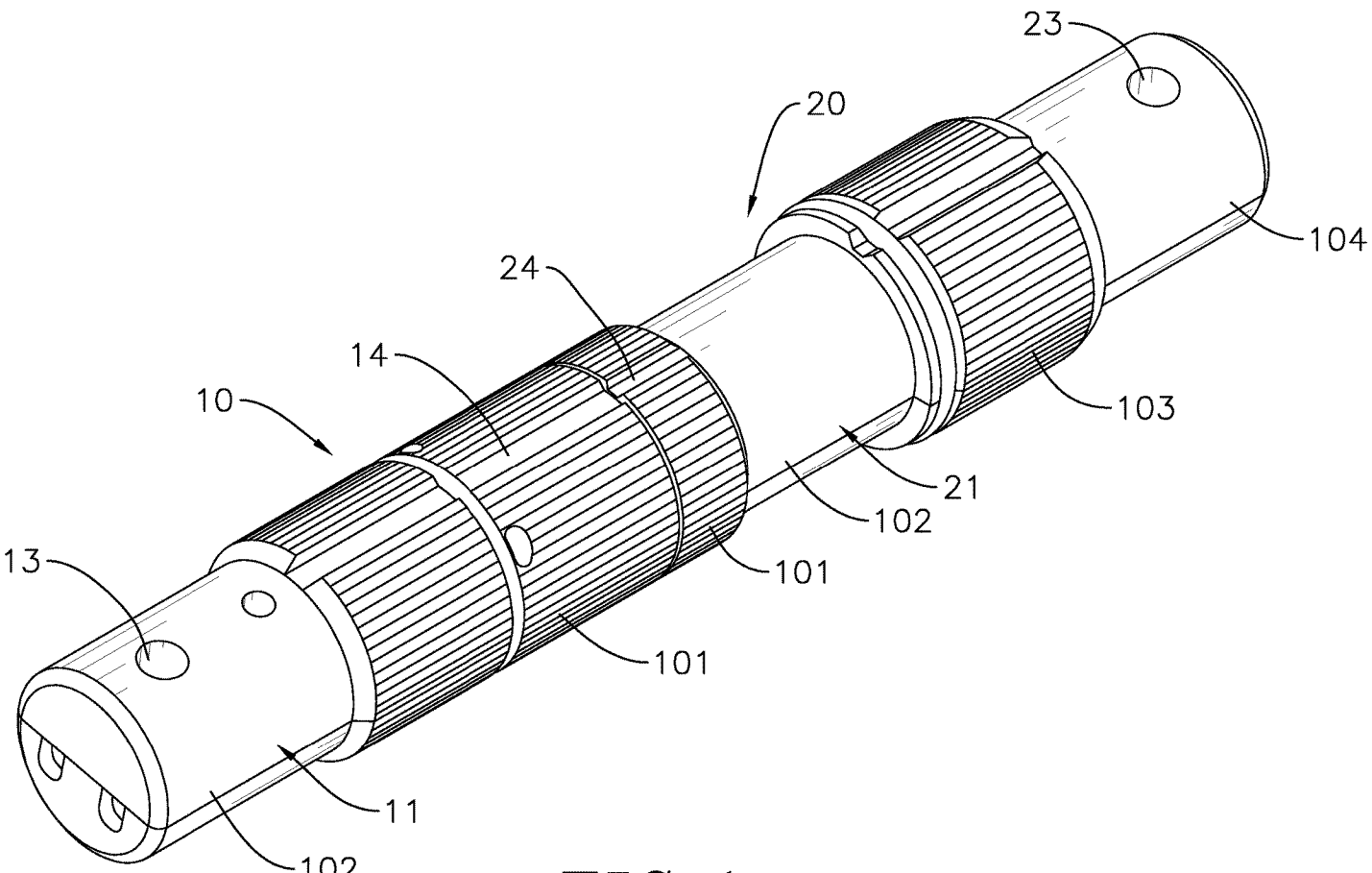
FIG. 1 is a perspective view of a pin connector assembly in accordance with the present invention.

With reference to FIG. 1, a pin connector assembly in accordance with the present invention comprises a male connector 10 and a female connector 20.

Figure 2:
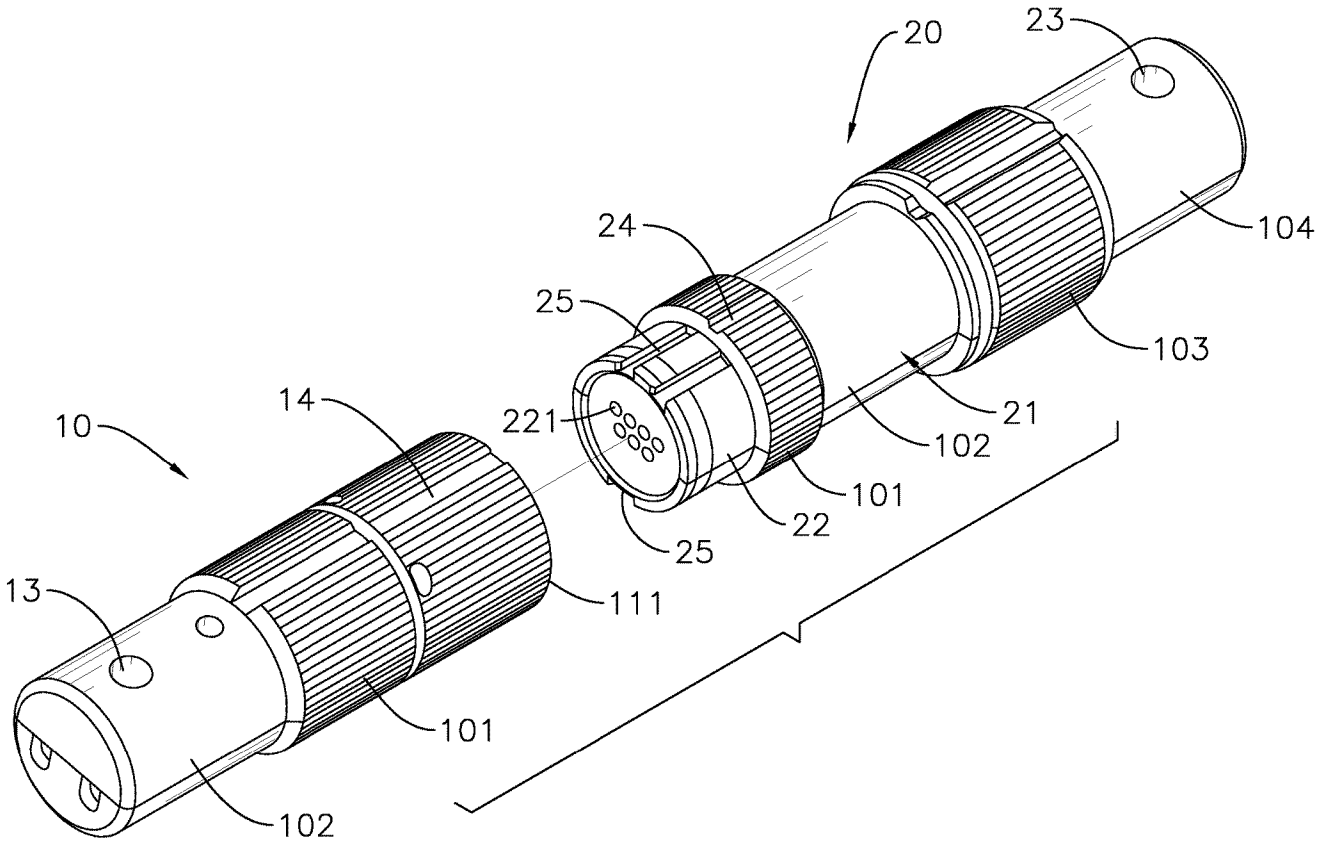
FIG. 2 is an exploded perspective view of the pin connector assembly in FIG. 1.
Figure 3:
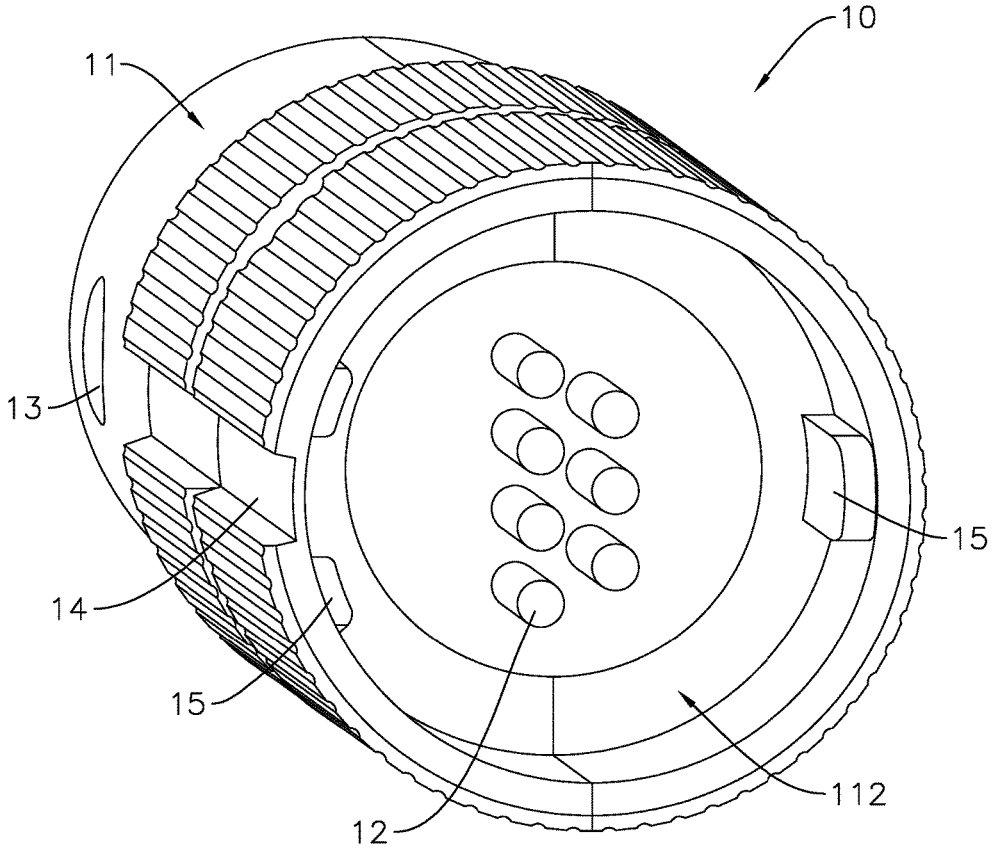
FIG. 3 is a perspective of a male connector of the pin connector assembly in FIG. 1.

With further reference to FIGS. 2 and 3, the male connector 10 has a first housing 11, multiple metal contacts 12, a mounting hole 13, a first alignment slot 14, and at least one engaging protrusion 15.

The first housing 11 is tubular and elongated, and has a mounting end, a connecting end 111, an outer side surface, a receiving recess 112, an inner side surface, and an inner bottom. The connecting end 111 of the first housing 11 is disposed opposite to the mounting end of the first housing 11 and has an end surface. An axial direction of the first housing 11 is defined to extend through the connecting end 111 of the first housing 11 and the mounting end of the first housing 11. The receiving recess 112 is formed in the end surface of the connecting end 111 of the first housing 11 and extends along the axial direction of the first housing 11. The inner side surface of the first housing 11 is defined around the receiving recess 112. The inner bottom is defined in the receiving recess 112.

The metal contacts 12 are mounted in the receiving recess 112 and on the inner bottom of the first housing 11.

The mounting hole 13 of the male connector 10 is formed through the mounting end of the first housing 11 and extends perpendicular to the axial direction of the first housing 11, i.e. the mounting hole 13 of the male connector 10 is radially formed through the mounting end of the first housing 11. The mounting hole 13 of the male connector 10 is used for detachably mounting the male connector 10 on a tube of a trunk of an artificial Christmas tree.

The first alignment slot 14 is formed on the outer side surface of the first housing 11 and extends along the axial direction of the first housing 11.

The at least one engaging protrusion 15 is formed on the inner side surface of the first housing 11.

As shown in FIG. 2, the female connector 20 has a second housing 21, a plug portion 22, a mounting hole 23, a second alignment slot 24, and at least one engaging slot 25.

The second housing 21 is tubular and elongated, and has a mounting end, a connecting end, and an outer side surface. The connecting end of the second housing 21 is disposed opposite to the mounting end of the second housing 21. An axial direction of the second housing 21 is defined to extend through the connecting end of the second housing 21 and the mounting end of the second housing 21.

The plug portion 22 axially protrudes from the connecting end of the second housing 21, fits within the receiving recess 112 of the first housing 11 of the male connector 10, and has an outer side surface, an end surface, and multiple insertion holes 221. The insertion holes 221 is formed in the end surface of the plug portion 22 and respectively correspond in position to the metal contacts 12 of the male connector 10 for the metal contacts 12 to be respectively inserted into the insertion holes 221.

The mounting hole 23 of the female connector 20 is formed through the mounting end of the second housing 21 and extends perpendicular to the axial direction of the second housing 21, i.e. the mounting hole 23 of the female connector 20 is radially formed through the mounting end of the second housing 21. The mounting hole 23 of the female connector 20 is used for detachably mounting the female connector 20 on another tube of the trunk of the artificial Christmas tree.

The second alignment slot 24 is formed on the outer side surface of the second housing 21, extends along the axial direction of the second housing 21, and aligns with the first alignment slot 14 of the male connector 10 when the female connector 20 and the male connector 10 are electrically coupled together.

The at least one engaging slot 25 is formed in the outer side surface of the plug portion 22. Each of the at least one engaging slot 25 extends along the axial direction of the second housing 21 and receives and engages with a corresponding one of the at least one engaging protrusion 15 of the male connector 10 when the female connector 20 and the male connector 10 are electrically coupled together.

In the preferred embodiment, the at least one engaging protrusion 15 of the male connector 10 includes three engaging protrusions 15. The three engaging protrusions 15 are separately formed on the inner side surface of the first housing 11. Each of the three engaging protrusions 15 is circumferentially offset to the first alignment slot 14 of the male connector 10. The at least one engaging slot 25 of the female connector 20 includes three engaging protrusions 25. The three engaging slot 25 are separately formed in the outer side surface of the plug portion 22 of the female connector 20. Each of the three engaging slots 25 is circumferentially offset to the second alignment slot 24 of the female connector 20.

In the preferred embodiment, the first housing 11 of the male connector 10 has a first portion 101 and a second portion 102. The first and second portions 101, 102 of the first housing 11 are defined as being sequentially arranged from the connecting end 111 of the first housing 11 to the mounting end of the first housing 11. On the first portion 101 of the first housing 11, the outer side surface of the first housing 11 is fluted. The first alignment slot 14 of the male connector 10 is axially formed in the first portion 101 of the first housing 11. On the second portion 102 of the first housing 11, the outer side surface of the first housing 11 is smooth. The mounting hole 13 of the male connector 10 is radially formed through the second portion 102 of the first housing 11. Moreover, a diameter of the first portion 101 of the first housing 11 is larger than a diameter of the second portion 102 of the first housing 11.

The second housing 21 of the female connector 20 has a first portion 201, a second portion 202, a third portion 203, and a fourth portion 204. The first, second, third, and fourth portions 201, 202, 203, 204 of the second housing 21 are defined as being sequentially arranged from the connecting end of the second housing 21 to the mounting end of the second housing 21. On the first and third portions 201, 203 of the second housing 21, the outer side surface of the second housing 21 is fluted. The second alignment slot 24 of the female connector 20 is axially formed in the first and third portions 201, 203 of the second housing 21. On the second and fourth portions 202, 204 of the second housing 21, the outer side surface of the second housing 21 is smooth. The plug portion 22 axially protrudes from the first portion 201 of the second housing 21. The mounting hole 23 of the female connector 20 is radially formed through the fourth portion 204 of the second housing 21. Moreover, diameters of the first and third portions 201, 203 of the second housing 21 are larger than diameters of the second and fourth portions 202, 204 of the second housing 21.

The pin connector assembly as described has the following advantages. With the first alignment slot 14 on the outer side surface of the first housing 11 and the second alignment slot 24 of the outer side surface of the second housing 21, the plug portion 22 of the female connector 20 is able to be inserted into the receiving recess 112 of the male connector 10 by aligning the first alignment slot 14 with the second alignment slot 24, so as to properly insert the metal contacts 12 of the male connector 10 into the insertion holes 221 of the female connector 20. The metal contacts 12 are not damaged and the service life of the pin connector assembly is prolonged. Moreover, the installation efficiency of the male connector 10 and the female connectors 20 is efficiently improved, such that assembling the tubes of the trunk of the artificial Christmas tree can be facilitated.

By detachably mounting the male connector 10 and the female connector 20 on the tube of the trunk of the artificial Christmas tree via the mounting holes 13, 23, shapes of the first housing 11 and the second housing 21 do not have to accurately fit shapes of the tube, such that manufacture of the artificial Christmas tree can also be facilitated. Moreover, the male connector 10 and the female connector 20 are able to be easily detached from the tube for replacement.

In addition, since the multiple metal contacts 12 are provided on the male connector 10 and the multiple insertion holes 221 are provided on the female connector 20, the pin connector assembly of the present invention is able to connect multiple lines of lights, so as to allow the artificial Christmas tree to be more attractive.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pin connector assembly comprising:

a male connector having a first housing being tubular and elongated, and having a mounting end;

a connecting end disposed opposite to the mounting end of the first housing and having an end surface;

an outer side surface;

a receiving recess axially formed in the end surface of the connecting end of the first housing;

an inner side surface defined around the receiving recess; and an inner bottom defined in the receiving recess;

multiple metal contacts mounted in the receiving recess and on the inner bottom of the first housing;

a mounting hole radially formed through the mounting end of the first housing;

a first alignment slot formed on the outer side surface of the first housing and axially extending along the first housing; and at least one engaging protrusion formed on the inner side surface of the first housing; and a female connector having a second housing being tubular and elongated, and having a mounting end;

a connecting end disposed opposite to the mounting end of the second housing; and an outer side surface;

a plug portion axially protruding from the connecting end of the second housing, fitting within the receiving recess of the first housing of the male connector, and having an outer side surface;

an end surface; and multiple insertion holes formed in the end surface of the plug portion and respectively corresponding in position to the metal contacts of the male connector for the metal contacts to be respectively inserted into the insertion holes;

a mounting hole radially formed through the mounting end of the second housing;

a second alignment slot formed on the outer side surface of the second housing, axially extending along the second housing, and aligning with the first alignment slot of the male connector when the female connector and the male connector are electrically coupled together; and at least one engaging slot formed in the outer side surface of the plug portion, and each of the at least one engaging slot extending axially and receiving and engaging with a corresponding one of the at least one engaging protrusion of the male connector when the female connector and the male connector are electrically coupled together.

2. The pin connector assembly as claimed in claim 1, wherein the at least one engaging protrusion of the male connector includes three engaging protrusions separately formed on the inner side surface of the first housing, and each of the three engaging protrusions is circumferentially offset to the first alignment slot of the male connector; and the at least one engaging slot of the female connector includes three engaging protrusions separately formed in the outer side surface of the plug portion of the female connector, and each of the three engaging slots is circumferentially offset to the second alignment slot of the female connector.

3. The pin connector assembly as claimed in claim 1, wherein the first housing of the male connector has a first portion and a second portion, and the first and second portions of the first housing are defined as being sequentially arranged from the connecting end of the first housing to the mounting end of the first housing;

on the first portion of the first housing, the outer side surface of the first housing is fluted;

the first alignment slot of the male connector is axially formed in the first portion of the first housing;

on the second portion of the first housing, the outer side surface of the first housing is smooth;

the mounting hole of the male connector is radially formed through the second portion of the first housing.

4. The pin connector assembly as claimed in claim 3, wherein a diameter of the first portion of the first housing is larger than a diameter of the second portion of the first housing.

5. The pin connector assembly as claimed in claim 3, wherein the second housing of the female connector has a first portion, a second portion, a third portion, and a fourth portion, and the first, second, third, and fourth portions of the second housing are defined as being sequentially arranged from the connecting end of the second housing to the mounting end of the second housing;

on the first and third portions of the second housing, the outer side surface of the second housing is fluted;

the second alignment slot of the female connector is axially formed in the first and third portions of the second housing;

on the second and fourth portions of the second housing, the outer side surface of the second housing is smooth;

the plug portion axially protrudes from the first portion of the second housing; and the mounting hole of the female connector is radially formed through the fourth portion of the second housing.

6. The pin connector assembly as claimed in claim 5, wherein diameters of the first and third portions of the second housing are larger than diameters of the second and fourth portions of the second housing.

7. The pin connector assembly as claimed in claim 5, wherein the at least one engaging protrusion of the male connector includes three engaging protrusions separately formed on the inner side surface of the first housing, and each of the three engaging protrusions is circumferentially offset to the first alignment slot of the male connector; and the at least one engaging slot of the female connector includes three engaging protrusions separately formed in the outer side surface of the plug portion of the female connector, and each of the three engaging slots is circumferentially offset to the second alignment slot of the female connector.

8. The pin connector assembly as claimed in claim 4, wherein the second housing of the female connector has a first portion, a second portion, a third portion, and a fourth portion, and the first, second, third, and fourth portions of the second housing are defined as being sequentially arranged from the connecting end of the second housing to the mounting end of the second housing;

on the first and third portions of the second housing, the outer side surface of the second housing is fluted;

the second alignment slot of the female connector is axially formed in the first and third portions of the second housing;

on the second and fourth portions of the second housing, the outer side surface of the second housing is smooth;

the plug portion axially protrudes from the first portion of the second housing; and the mounting hole of the female connector is radially formed through the fourth portion of the second housing.

9. The pin connector assembly as claimed in claim 8, wherein diameters of the first and third portions of the second housing are larger than diameters of the second and fourth portions of the second housing.

10. The pin connector assembly as claimed in claim 3, wherein the at least one engaging protrusion of the male connector includes three engaging protrusions separately formed on the inner side surface of the first housing, and each of the three engaging protrusions is circumferentially offset to the first alignment slot of the male connector; and the at least one engaging slot of the female connector includes three engaging protrusions separately formed in the outer side surface of the plug portion of the female connector, and each of the three engaging slots is circumferentially offset to the second alignment slot of the female connector.

11. The pin connector assembly as claimed in claim 1, wherein the second housing of the female connector has a first portion, a second portion, a third portion, and a fourth portion, and the first, second, third, and fourth portions of the second housing are defined as being sequentially arranged from the connecting end of the second housing to the mounting end of the second housing;

on the first and third portions of the second housing, the outer side surface of the second housing is fluted;

the second alignment slot of the female connector is axially formed in the first and third portions of the second housing;

on the second and fourth portions of the second housing, the outer side surface of the second housing is smooth;

the plug portion axially protrudes from the first portion of the second housing; and the mounting hole of the female connector is radially formed through the fourth portion of the second housing.

12. The pin connector assembly as claimed in claim 11, wherein diameters of the first and third portions of the second housing are larger than diameters of the second and fourth portions of the second housing.

13. The pin connector assembly as claimed in claim 11, wherein the at least one engaging protrusion of the male connector includes three engaging protrusions separately formed on the inner side surface of the first housing, and each of the three engaging protrusions is circumferentially offset to the first alignment slot of the male connector; and the at least one engaging slot of the female connector includes three engaging protrusions separately formed in the outer side surface of the plug portion of the female connector, and each of the three engaging slots is circumferentially offset to the second alignment slot of the female connector.

* * * * *